United States Patent [19]

Sakata

[11] Patent Number: 4,535,473

[45] Date of Patent: Aug. 13, 1985

[54] APPARATUS FOR DETECTING THE DURATION OF VOICE

[75] Inventor: Tomio Sakata, Tokyo, Japan

[73] Assignee: Tokyo Shibaura Denki Kabushiki Kaisha, Kawasaki, Japan

[21] Appl. No.: 412,234

[22] Filed: Aug. 27, 1982

[30] Foreign Application Priority Data

Oct. 31, 1981 [JP] Japan ..... 56-175431

[51] Int. Cl.[3] ..... G10L 1/00

[52] U.S. Cl. ..... 381/46; 358/282; 382/51

[58] Field of Search ..... 381/41–47; 358/282; 382/51

[56] References Cited

U.S. PATENT DOCUMENTS 4,272,789 6/1981 Biron ..... 358/282

4,351,983 9/1982 Crouse et al. ..... 381/46

OTHER PUBLICATIONS

Dorr, et al., "Thresholding Method", IBM Tech. Disclosure Bull., vol. 15, No. 8, Jan. 1953, p. 2595.

Proceedings of the 4th International Joint Conference on Pattern Recognition pp. 592–596; "Discriminant and Least Squares Threshold Selection"; Nobuyuki Otsu; 1978.

*Primary Examiner*—E. S. Matt Kemeny

*Attorney, Agent, or Firm*—Oblon, Fisher, Spivak, McClelland & Maier

[57] ABSTRACT

The detection of voice (speech) signal presence in input signal-plus-noise is improved by more accurate determination of the decision threshold, which is determined by first finding a medium-length interval consisting of noise-signal-noise (no-signal, signal, no-signal), then calculating a histogram (energy probability distribution) for the interval, then finding the maximum value of variance of the histogram as the optimal threshold, plus an arbitrary offset.

5 Claims, 9 Drawing Figures

APPARATUS FOR DETECTING THE DURATION OF VOICE

BACKGROUND OF THE INVENTION

This invention relates to an apparatus for detecting the duration of voice.

In order to recognize separately pronounced words or series of words by a pattern matching method or other similar methods, it is required to correctly detect the duration of each voice generated word or a series of words. If a word is pronounced or spoken when the ambient noise is relatively small, for instance, when the S/N ratio is 30 dB or more and a wideband microphone is used to derive a corresponding voice signal, the duration of the voice generated word or series of words can easily be detected by determining the period during which its amplitude and the number of its zero intersections remain above a predetermined value.

When the ambient noise is large or changes at a high rate, however, it is impossible to correctly detect the duration of a voice generated word or series of words, no matter what data-processing has been carried out to determine the proper threshold value. If the threshold value is set relatively small, a noise larger than the threshold value may frequently be generated, and a so-called "addition error" may occur many times. Conversely, if the threshold value is set relatively large, a voice component whose level is lower than the threshold value may fall out, and a so-called "fall-off error" may occur many times. If the non-voice period can be determined, the threshold value can be changed according to the ambient noise level. In general, however, a non-voice period can not be properly determined. It is therefore extremely difficult to correctly detect the duration of an input voice generated word.

SUMMARY OF THE INVENTION

Accordingly, it is an object of the present invention to provide an apparatus which can correctly detect the duration of a voice generated word or series of words.

According to one aspect of this invention, an apparatus for detecting the duration of voice is provided which comprises sampling means for sampling the input voice signal and generating a time-sequence of voice parameters; memory means, connected to said sampling means, for storing the time-sequence of voice parameters; first determining means for determining based on the time-sequence of voice parameters an interval which is divided into three periods, an estimated voice period, a first non-voice period preceding said voice period and a second non-voice period succeeding said voice period; means for forming a histogram based on the voice parameters generated during said interval to divide the voice parameters into non-voice class and voice class; second determining means for determining a threshold value based on the average of voice parameters in the non-voice class; and third determining means for determining the voice duration based on the threshold value and the voice parameters generated during said interval and stored in said memory means.

In one embodiment of this invention, a time interval which includes a voice period and non-voice period is first detected based on a time-sequence of voice parameters for the voice signal. Then, the histogram of the voice parameters pertaining to that period of time is determined. The average value of the voice parameters pertaining to the non-voice period is calculated from the voice parameter distribution. A threshold value is then determined in accordance with the mean value thus calculated, thereby effectively accomplishing the above-mentioned object of this invention.

The time sequence of voice parameters for the voice signal is used in order to detect the duration of an input voice generated word. When a human looks at a graph showing the time sequence of voice parameters, the duration of the input voice generated word can be recognized correctly. This is because whether each voice parameter belongs to a voice period or a non-voice period can easily be determined and, at the same time, an optimum threshold value for detecting the duration of the input voice can easily be determined. Thereafter, in accordance with the threshold value it can be determined whether or not each voice parameter pertains to the duration of the input voice generated word. Further, it can also be determined if voice parameters pertaining to the voice period are successively generated for more than a preset period of time. Based on the data thus provided, the duration of the input voice generated word is determined. This process in which a human perceives the duration of an input voice generated word is applied to the voice duration detecting apparatus of a voice recognition system, thus enabling the apparatus to detect correctly the duration of an input voice generated word.

DETAILED DESCRIPTION OF THE PREFERRED EMBODIMENT

There will now be described a voice duration detecting apparatus according to one embodiment of this invention with reference to the accompanying drawings. Here, short-time-energy data E are derived from an input voice signal as voice parameters. However, other voice parameters may be used to serve the same purpose.

Figure 1:
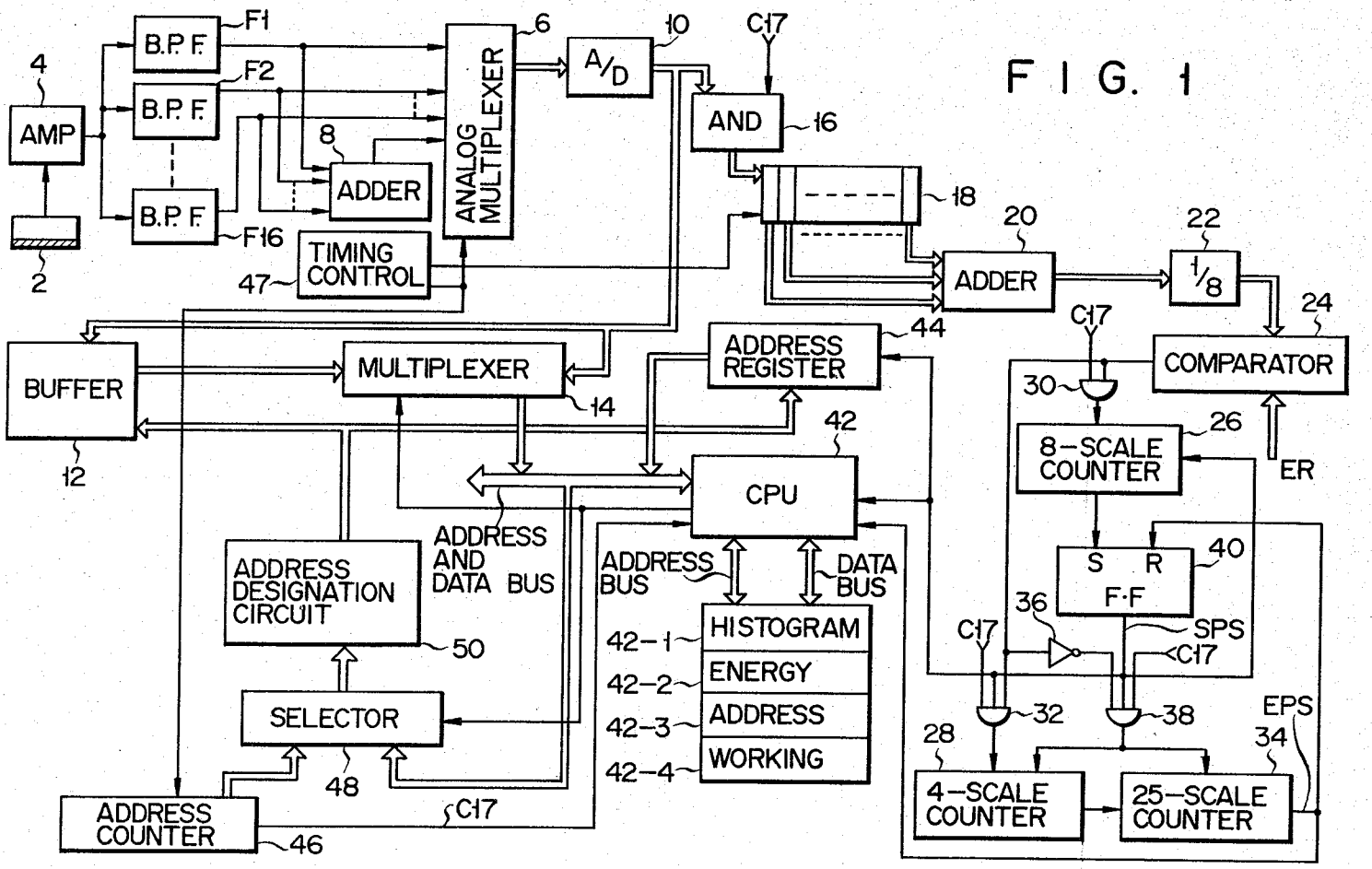
FIG. 1 is a circuit diagram of a voice duration detecting apparatus according to one embodiment of this invention.
Figure 2:
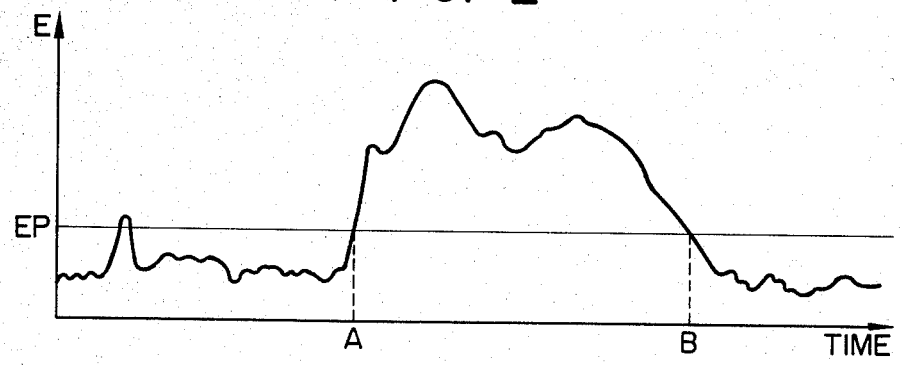
FIG. 2 shows a waveform illustrating a time sequence of short-time-energy parameters of an input signal.

First, a moving average $\bar{E}$ or a plurality of successive short-time-energy data E shown in FIG. 2 is calculated as described later with reference to FIG. 1, and is compared with a predetermined value ER to detect time points A1 and B1 shown in FIG. 3. At the time point A1, the moving average $\bar{E}$ becomes larger than the predetermined value ER for the first time, and at the time point B1, the moving average $\bar{E}$ becomes smaller than the predetermined value ER after the time point A1. That portion of the input voice which is defined by the time points A1 and B1 may be the most reliable portion as a voice period. The time point A1 is estimated as a starting point for determining the duration of the input voice signal, and the time point B1 as the end point for determining the duration of the input voice signal.

The determination of the moving average of the voice parameters pertaining to the period between the estimated starting and end points of the input voice signal is significant in the following respect. As well known, the short-time-energy data is a relatively effective parameter for distinguishing a voice period and a non-voice period. However, if an input voice has been generated where the ambient noise is relatively large, it probably contains a pulsative noise which has an instantaneously great energy. Therefore, such a pulsative noise may be contained in that portion of the input voice signal which is defined by the time points A1 and B1 if the energy data E is used to detect the estimated starting and end points of the input voice signal duration. This is why the moving average of the voice parameters (or short-time-energy data) are calculated, thereby suppressing pulsative noises which are contained in the input voice signal and thus obtaining a graph of the moving average as shown in FIG. 3. Thus, using the moving average of the voice parameters which have been calculated in the above-mentioned process, it becomes possible to correctly detect the duration of an input voice regardless of pulsative noises. Further, a time point M at which the short-time-energy data E is the largest during the period between the time points A1 and B1 is detected as a time point at which it is most probable that a true voice duration covers.

Figure 4:
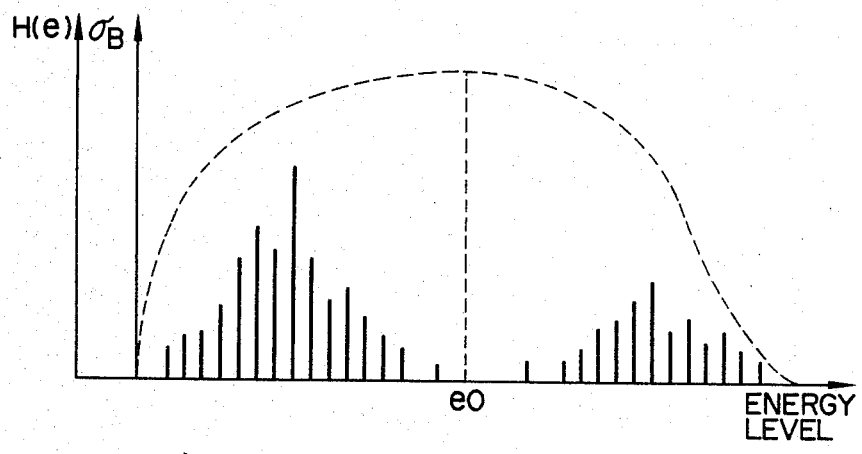
FIG. 4 shows a histogram of the short-time-energy parameters of an input signal shown in FIG. 2.

Two non-voice periods Nu of, for example, 100 to 200 msec are provided, one starting at a time point A2 and ending at the time point A1 and the other starting at the time point B1 and ending at a time point B2. The period between the time points A2 and B2 is the histogram calculation period. Each non-voice period may be set to 100 to 200 msec. The histogram calculation period therefore consists of the estimated non-voice period between the time points A2 and A1, the estimated voice period between the time points A1 and B1 and the estimated non-voice period between the time points B1 and B2. The voice parameters pertaining to the histogram calculation period are used to calculate and provide the histogram as shown in FIG. 4. Next, a threshold value is used to divide a plurality of short-time-energy data E into two classes in accordance with the histogram. That is, energy data E are divided into a non-voice class where the energy data E is smaller than the threshold value EO and a voice class where the energy data E is greater than the threshold value EO. More specifically, a between-class variance $\sigma_B$ is determined and then an optimum threshold value EO which makes the between-class variance $\sigma_B$ maximum is determined. According to the optimum threshold value EO and the histogram of the non-voice class where E<EO, the mean value EN of the energy data E in the non-voice region is determined. A predetermined value is added to the mean value of the energy data EN to compensate for the fluctuation of the energy data E, and the added value is used as a proper threshold value EP for detecting the duration of an input voice signal.

In order to obtain the optimum threshold value EO for dividing the distribution of energy data E into a voice class and a non-voice class, the reference value may be varied from the minimum value of energy E to the maximum value of the energy data E, and the between-class variance $\sigma_B$ is determined. Then, the optimum threshold value EO is determined which causes the between-class variance $\sigma_B$ to be maximum. This method, however, is very complicated. Since the $\sigma_B$-E characteristic curve has only one inflection point, this inflection point may be considered to be the maximum between-class variance $\sigma_B$. Thus, the threshold value corresponding to the maximum between-class variance $\sigma_B$ may be regarded as the optimum threshold value EO.

The optimum threshold value EP may be obtained by a gray level histogram of the energy data E as follows:

Step 1: Divide a group of energy data E into two classes, background noise class C1 and voice class C2, using a between-class variance as a reference value for evaluating either class.

Step 2: Obtain the average EN of the energy data E of frames which fall within the background noise class C1.

Step 3: Add a predetermined margin $\alpha$ to the average EN, thus obtaining the threshold value EP.

The steps mentioned above will now be described more in detail.

Suppose energy data E may have discrete values (e−1): e=1, 2, . . . , L. Table H(e) which defines a gray-level histogram of the energy data E having a value (e−1) shows the number Ne of frames in which the energy data E has the same value during a period (between the time points A2 and B2). Then, the relation of N and Ne (e=1, 2, . . . , L) is:

$$N = \sum_{e=1}^{L} Ne \tag{1}$$

where N is the number of frames existing during the period between the time points A2 and B2.

To simplify the matter, the gray-level histogram is regarded here as a histogram normalized by N (or a probability density Pe), which is given:

$$Pe = Ne/N\left(Pe \geqq 0,\ \sum_{e=1}^{L} Pe = 1\right) \tag{2}$$

Suppose that, using a value k as a threshold value, the values of the energy data E are divided into background noise class C1 which includes the energy data having a value of S1 (=1, 2, . . . , k) and voice class C2 which includes the energy data having a value of S2 (=K+1, K+2, . . . , L). Probability $\omega 1$ of class C1 and probability $\omega 2$ of class C2 are given as follows:

$$\omega 1 = Pr(C1) = \sum_{e \in S1} Pe = \omega(k) \tag{3}$$

$$\omega 2 = Pr(C2) = \sum_{e \in S2} Pe = 1 - \omega(k) \tag{4}$$

Expectation $\mu_T$ of e during the period between the time points A2 and B2, expectatin $\mu_1$ of e for C1 and expectation $\mu_2$ of e for C2 will be given as follows:

$$\mu_T = \sum_{e=1}^{L} e \cdot Pe = \mu(L) \tag{5}$$

$$\mu_1 = \sum_{e \in S1} e \cdot Pr(e|C1) = \frac{1}{\omega 1} \sum_{e \in S1} e \cdot Pe = \mu(k)/\omega(k) \tag{6}$$

-continued $$\mu_2 = \sum_{e \epsilon S2} e \cdot Pr(e1C2) = \frac{1}{\omega 2} \sum_{e \epsilon S2} e \cdot Pe = \frac{\mu_T - \mu(k)}{1 - \omega(k)} \quad (7)$$

where $$\mu(k) = \sum_{e=1}^{k} e \cdot Pe \quad (8)$$

Variance $\sigma_B$ between the classes C1 and C2 is determined as follows:

$$\sigma_B = \omega 1(\mu_1 - \mu_t)^2 + \omega 2(\mu_2 - \mu_T)^2 \quad (9)$$

As equation (9) shows, the greater the between-class variance $\sigma_B$ is, the more clearly the classes C1 and C2 are separated from each other. Let equations (3) to (7) be put into equation (9). Then, the following equation is obtained:

$$\sigma_B^2(k) = \frac{[\mu_T \cdot \omega(k) - \mu(k)]^2}{\omega(k)(1 - \omega(k))} \quad (10)$$

To determine the optimum threshold value for separating the background noise class C1 from the voice class C2, it is necessary to evaluate the between-class variance $\sigma_B$ for every value that k may have, i.e. k=1, k=2, . . . , k=L. Thus far the gray-level histogram has been regarded as a normalized one. In practice, however, the table H(e) shows how often the energy data having the same value e is obtained. Accordingly, it is required to change the equation (10) as follows:

$$\sigma_B^2(k) = \frac{[\mu_T \cdot N \cdot \omega(k) - N \cdot \mu(k)]^2}{N \cdot \omega(k)[N - N \cdot \omega(k)]}, \quad (11)$$

where:

$$\mu_T = \sum_{e=1}^{L} e\, pe = \frac{1}{N} \sum_{e=1}^{L} e \cdot Ne \quad (12)$$

$$N \cdot \omega(k) = N \cdot \sum_{e \epsilon S1} Pe = \sum_{e=1}^{k} Ne \quad (13)$$

$$N \cdot \mu(k) = N \cdot \sum_{e=1}^{k} e \cdot Pe = \sum_{e=1}^{k} e \cdot Ne. \quad (14)$$

Let equations (12), (13) and (14) be put into equation (11). Then:

$$\sigma_B^2(k) = \frac{\left[\mu_T \cdot \sum_{e=1}^{k} e \cdot Ne - \sum_{e=1}^{k} e \cdot Ne\right]^2}{\left(\sum_{e=1}^{k} Ne\right)\left[N - \left(\sum_{e=1}^{k} Ne\right)\right]}. \quad (15)$$

$\sigma_B$ is evaluated for every value that k may have, i.e. k=1, k=2, . . . , k=L. The value of k ($k=e_0$) at which $\sigma_B$ has the greatest value is used as the threshold value for dividing the energy data E into the background noise class C1 and the voice class C2. The average value of energy data E in the background noise class C1, i.e. the average $E_N$, is given:

$$E_N = \mu(e_0)/\omega(e_0) = \sum_{e=1}^{e_0} e \cdot Ne / \sum_{e=1}^{e_0} Ne. \quad (16)$$

Needless to say, there is indeed a frame or frames of noise having an energy level greater than EN which is the average value of energy data E in the background noise class C1. If EN is directly used as the threshold value EP for detecting the second-stage voice period, an addition error will be made when consecutive frames have energy data greater than EN. This is why a predetermined value $\alpha$ is added to EN, thus obtaining the threshold value EP. Hence, EP is expressed as follows:

$$EP = EN + \alpha \quad (17).$$

EP can be efficiently obtained in the following manner.

Step A: Read out data from the histogram table H(e) (e=1, 2, . . . , L) to calculate B(k) and C(k) for every value that e may have and write B(k) and C(k) in work tables, B(k) and C(k) being given as follows:

$$B(k) = \sum_{e=1}^{k} H(e) = B(k-1) + H(k) \quad (18)$$

$$C(k) = \sum_{e=1}^{k} e \cdot H(e) = C(k-1) + k \cdot H(k) \quad (19)$$

Step B: Calculate $\mu_T$, using the following equation:

$$\mu_T = \frac{1}{N} \sum_{e=1}^{L} e \cdot Ne = C(L)/B(L) \quad (20)$$

Step C: Use the values B(k) and C(k) to rewrite equation (15) as follows:

$$\sigma_B^2(k) = \frac{(\mu_T B(k) - C(k))^2}{B(k)(N - B(k))} \quad (21)$$

Evaluate $\sigma_B^2$ of equation (21), using the values written in the work tables, thereby determining the value of k ($=e_0$) at which $\sigma_B$ becomes maximum. If $\sigma_B$ has the same maximum value when $e_1 \leqq k \leqq e_m$, use $(e_m - e_1)/2$ as value $e_0$.

Step D: Calculate the average EN of background noise, using the following equation:

$$EN = C(e_0)/B(e_0) \quad (22)$$

Step E: Calculate the threshold value EP, using the following equation:

$$EP = EN + \alpha.$$

The starting point A and the end point B of an input voice signal is determined as explained hereinafter. To detect the starting point A, the time sequence of energy data E is examined in reverse direction from the time point M, and the time $\overline{A}$ when the energy data E falls below the threshold value EP is detected. It is further examined whether or not the energy data E remains less than EP for a predetermined period N1. Period N1 is, for example, about 200 to about 250 msec. If the energy data E remains less than EP for the period N1, the time $\overline{A}$ is considered as the starting point A. In this case, even if the energy data E becomes greater than EP and is kept greater than EP for a period which is shorter than a predetermined period N2, it is considered that the input voice contains pulsative noise components, and the time point $\overline{A}$ is considered as the starting point A of the input voice duration.

If the energy data E becomes greater than EP after having fallen below EP and is kept greater than EP for a time longer than the period N2, another voice period within the same voice duration is considered to exist. Then, time at which the energy data E becomes less than EP is regarded as time $\overline{A}$, and a non-voice period N1 is detected. This process is repeated until the starting point A of the input voice is detected.

The end point B of the input voice is detected in a similar fashion. In this case, the time sequence of energy data E is examined in the forward direction from the time point M.

FIG. 1 shows a circuit of a voice duration detecting apparatus according to one embodiment of this invention. The voice duration detecting apparatus includes electric/acoustic converting device 2, such as a wide band microphone, for converting a voice or utterance to an electrical signal and 16 band-pass filters F1 to F16 for receiving a voice signal from the microphone 2 through an amplifier 4. The band-pass filters F1 to F16 have different frequency band widths sequentially varying from a low frequency region to a high frequency region. The output signals of the band-pass filters are supplied to an analog multiplexer 6 and adder 8. The output signal of the adder 8 is supplied as a seventeenth input signal to the analog multiplexer 6. That is, the multiplexer 6 receives in a parallel fashion short-time-energy signals in the 16 frequency band widths in a range from the low to the high frequency region and short-time-energy signal of the whole of the voice input signal.

The output signals for each frame of the analog multiplexer 6 are serially supplied to an analog/digital converter 10, converted to corresponding short-time-energy data E1 to E17, and then fed to a buffer memory 12, multiplexer 14 and AND circuit 16. The output data of the AND circuit 16 is supplied to, for example, an 8-stage shift register 18. The output data in the respective stages of the shift register 18 are added at an adder 20 and then the output of the adder 20 is divided by a $\frac{1}{8}$ divider 22 into one-eighth parts. The output data of the $\frac{1}{8}$ divider 22 is compared by a comparator 24 with a reference value ER. The output terminal of the comparator 24 is coupled respectively through AND gates 30 and 32 to the up-count terminals of an 8-scale counter 26 and 4-scale counter 28 and through an inverter 36 and AND gate 38 to the reset terminal of the 4-scale counter 28 and up-count terminal of a 25-scale counter 34. The output terminal of the 4-scale counter 28 is coupled to the reset terminal of the 25-scale counter 34 and the output terminals of the 8-and 25-scale counters 26 and 34 are coupled to the set and reset terminals of a flip-flop circuit 40, respectively. The output terminal of the flip-flop circuit 40 is connected to a central processing unit 42 and address register 44. The CPU 42 includes a random access memory having buffer memory areas 42-1 to 42-3 for storing histogram data, energy data and address data and working memory area 42-4 for storing calculation data.

The voice duration detecting circuit further includes an address counter 46 for counting the output pulses of a timing control circuit 47 and a selector 48 for causing the address data from CPU 42 and address counter 46 to be selectively supplied to an address designation circuit 50 which functions to designate an address of the buffer memory 12. The timing control circuit 47 produces 17 pulses in each frame of 10 m seconds. These seventeen pulses occur in a period of, for example, 1 m second so that a vacant period of 9 m seconds may be provided in each frame. The address counter 46 produces address data corresponding to the contents, and also a pulse signal C17 each time the seventeenth pulse in each frame is counted.

There will now be described the operation of the voice duration detecting apparatus shown in FIG. 1.

First, the memory areas 42-1 and 42-4 are cleared and the first address for the memory areas 42-2 and 42-3 are designated.

A voice or utterance having energy distribution as shown in FIG. 2 is supplied to the wide-range microphone 2 which in turn produces a corresponding electrical voice or utterance signal to the amplifier 4. An output signal of the amplifier 4 is supplied to the band-pass filters F1 to F16 which smooth the input signal and allow the signal components having frequencies in the respectively allotted frequency band widths to be supplied to the analog multiplexer 6 and adder 8. An output signal from the adder 8 is also supplied to the analog multiplexer 6. In response to an output pulse from the timing control circuit 47, the analog multiplexer 6 time-sequentially produces short-time-energy signals corresponding to output signals from the band-pass filters F1 to F16 and the adder 8 in this order. The short-time-energy signals are sequentially supplied to the A/D converter 10 which in turn produces corresponding digital energy data E1 to E17 as voice parameters to the buffer memory 12, multiplexer 14 and AND circuit 16. In this example, the energy data E17 is set to an integer ranging from 0 to $(L-1)$.

Since, in the initial state, the selector 48 is set to permit address data from the address counter 46 to be supplied to the address designation circuit 50, the address designation circuit 50 may designate the address location of the buffer memory 12 in accordance with the address data from the address counter 46 and the buffer memory 12 may store the energy data from the A/D converter 10 in designated address locations. The AND gate circuit 16 is enabled each time the address counter 46 produces a pulse signal C17, that is, each time the last pulse is generated in each frame from the timing control circuit 47. This causes the energy data E17 corresponding to the output signal from the adder 8 to be supplied to the 8-stage shift register 18 through the AND gate 16. The shift register 18 is driven in response to an output pulse from the timing control circuit 44 so as to shift energy data E17j to E17(j+7) generated in successive frames. The energy data E17j to E17(j+7) stored in the shift register 18 are added together in the adder 20 and divided by 8 in the $\frac{1}{8}$ divider 22 to generate a moving average $\bar{E}j$ for the energy data E17j to E17(j+7) as shown in FIG. 3. As is clearly seen from FIG. 3, pulse noise having been included in the energy distribution of FIG. 2 is eliminated by taking the moving average. The moving average $\bar{E}j$ is compared with the reference value ER in the comparator 24 which produces a high level output signal when detecting that the moving average $\bar{E}j$ becomes equal to or larger than the reference value ER. As far as the moving average $\bar{E}j$ is smaller than the reference value ER, the flip-flop circuit 40 is kept reset and all the AND gates 30, 32 and 38 are kept disabled.

Figure 3:
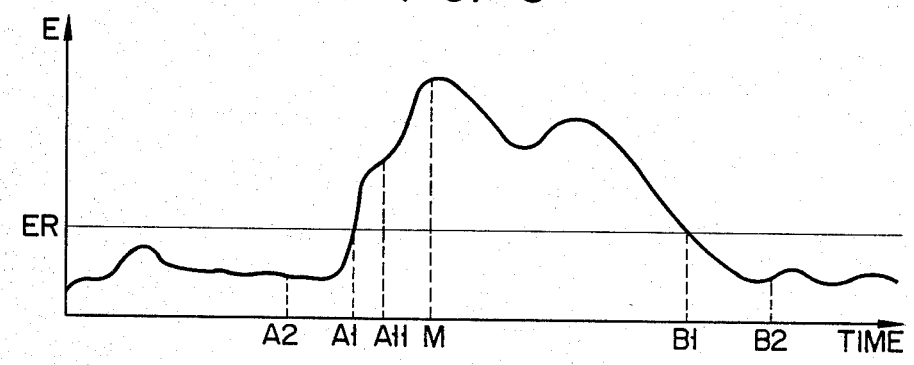
FIG. 3 shows a waveform of moving average derived from the time sequence of short-time-energy parameters.

When it is detected that the moving average Ej from the $\frac{1}{8}$ divider 22 becomes equal to the reference value ER, that is, a starting point A1 shown in FIG. 3 is reached, the comparator 24 produces a high level output signal to enable the AND gate 30. The AND gate 30 permits a pulse signal C17 generated from the address counter C17 to be supplied to the 8-scale counter 26. When the 8-scale counter 26 has counted eight pulses, that is, when a time point A11 is reached it produces an output signal to set the flip-flop circuit 40 which in turn produces a high level output signal SPS. The high level output signal SPS from the flip-flop circuit 40 is supplied as a latch signal to the address register 44 so that the address register can store an address data which is generated from the address designation circuit 50 and corresponds to a time point A11 shown in FIG. 3. In response to the high level output signal SPS from the flip-flop circuit 40, CPU 42 produces a high level output signal to the multiplexer 14 and selector 48 so that energy data can be transferred from the buffer register 12 to CPU 42 through the multiplexer 14 and address data can be supplied from CPU 42 to the address designation circuit 50 through the selector 48. At this time, CPU 42 calculates the address location for a point A2 based on the address data stored in the buffer register 44. Then, as will be described later, CPU 42 stores in the memory area 42-1 histogram data for energy data generated between the points A11 and A2. This operation may be effected in one frame that is, in a vacant period between a C17 pulse in one frame and a C1 pulse in the next frame, and after this operation, CPU 42 produces a low level output signal to the multiplexer 14 and selector 48 so that CPU 42 may receive energy data from the A/D converter 10 through the multiplexer 14 and the address designation circuit 50 will receive address data from the address counter 46 through the selector 48. Each time energy data are generated in each succeeding frame from the A/D converter 10, CPU 42 generates and stores histogram data in the memory area 42-1.

In the same manner as described above, short-time-energy data corresponding to the voice signal shown in FIG. 2 are successively stored in the buffer memory 12. When it is detected that the moving average $\bar{E}i$ becomes smaller than the reference value ER, that is, an estimated end point B1 shown in FIG. 3 is passed, the comparator 24 produces a low level output signal to disable the AND gates 30 and 32 and enable the AND gate 38. This causes the 25-scale counter 34 to start counting C17 pulses supplied through the AND gate 38. When 25 pulses are counted, that is, a point B2 is reached, the 25-scale counter 34 produces an output signal indicating that the voice interval has been preliminarily determined by the points A1 and B1. The output signal of the 25-scale counter 34 is supplied to the CPU 42 and to the flip-flop circuit 40 to reset the same. However, if a moving average larger than the reference value ER is detected after the point B1 is detected, the counting operation of the 25-scale counter 34 is interrupted and the 4-scale counter 28 starts the counting operation. If, in this case, an output signal from the comparator 24 is kept at a high level for a period longer than a preset period, the 4-scale counter 28 continues to count C17 pulses. When having counted four C17 pulses, the 4-scale counter 28 produces an output signal indicating that another voice section appears in the same voice interval, and resets the 25-scale counter 34. Thereafter, the same operation as described before is continuously effected so as to detect a preliminary end point of the voice interval. However, in a case where an output signal from the comparator 24 is kept at a high level only for a short time and the 4-scale counter 28 stops its counting operation before counting four pulses, the 4-scale counter 28 is reset and, at the same time, the 25-scale counter 34 starts its counting operation and supplies an output signal when the 25-scale counter 34 comes to have contents of "25".

In response to an output signal from the 25-scale counter 34, CPU 42 stops forming histogram data and determines final starting and end points A and B based on the histogram data as will be described later.

Figure 5A:
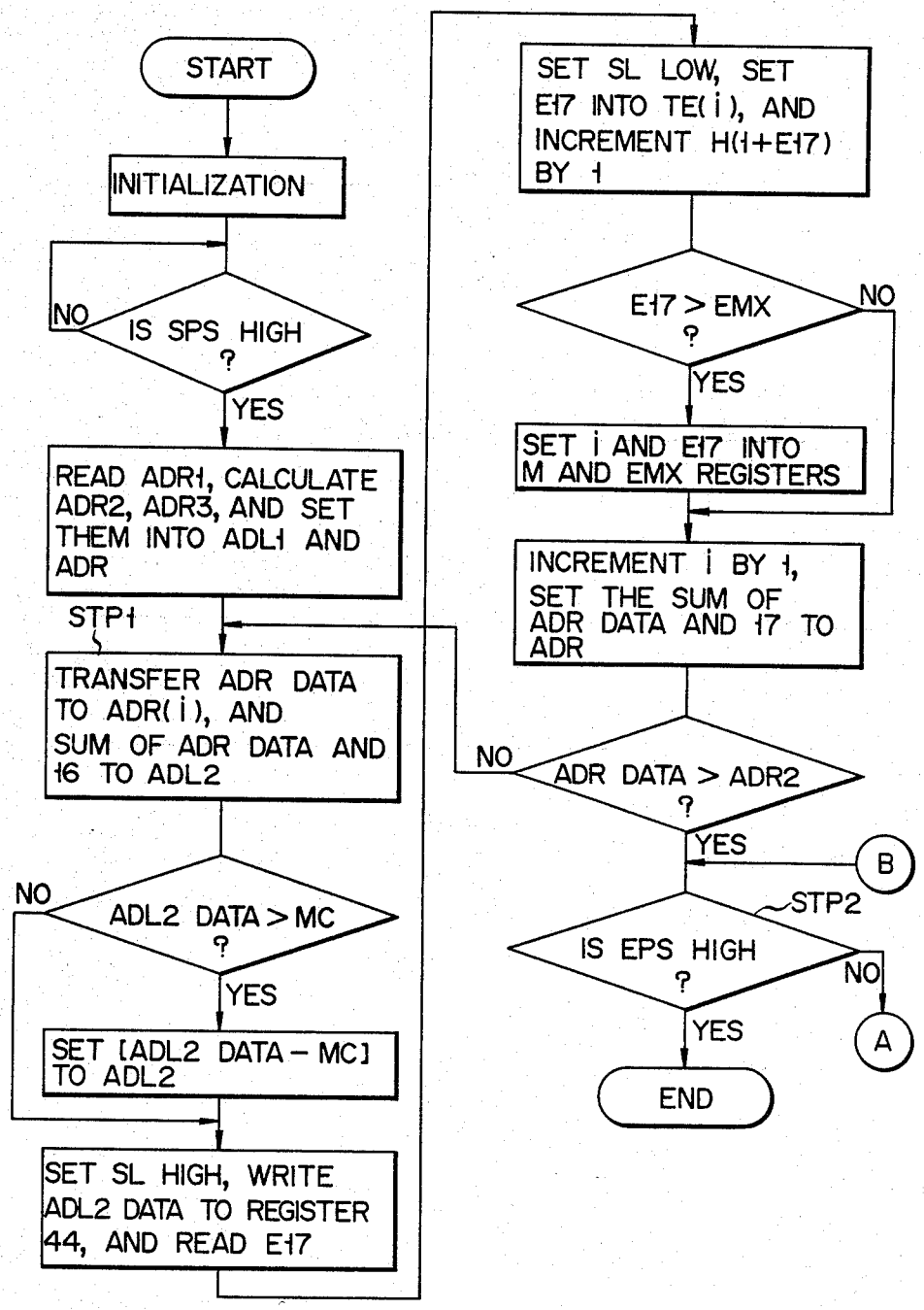
FIGS. 5A ad 5B are a flow chart for forming the histogram shown in FIG. 4.
Figure 5B:
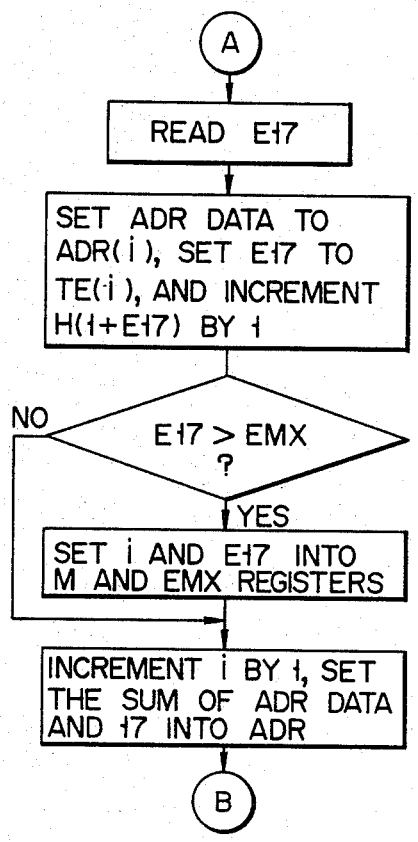

Referring now to FIG. 5, a description of the flow chart for forming a histogram by the CPU 42 will be given hereinafter. The buffer memory areas 42-1 to 42-3 (FIG. 1) are initialized by setting the value i, which indicates the frame number, to 1, the value EMX to 0 and the value H(e) to 0. The value of e is an integer from 1 to L. After initialization is set up, it is checked if an output signal SPS is generated from the flip-flop circuit 40. If it is detected that a high level output signal SPS is generated, an address data ADRl which is generated at the time point A11 to designate the address location for a 17-th energy data E17 of one frame and is stored in the address register 44 is read out, and address data ADR2 and ADR3 are derived based on the address data ADR1 and respectively written into first address location ADL1 of the address buffer memory area 42-3 and ADR register (not shown). The address data ADR2 indicates the address position of a first energy data E1 in that frame which includes the 17-th energy data E17 generated at the time point A11. The address data ADR3 indicates the address position of a first energy data E1 in that frame which includes a 17-th energy data E17 generated at the time point A2. The address data ADR2 and ADR3 are respectively derived as follows:

$$ADR2 = ADR1 - 16 \tag{23}$$

$$ADR3 = ADR1 - \{(8+25) \times 17 + 16\} \tag{24}$$

The address data stored in the ADR register is written into the address table location ADR(i) of the address buffer memory area 42-3 in a step STP1. Since the address data ADR3 is the first one, it is written into the address table location ADR(1). Then, the value of 16 is added to the address data stored in the ADR register and the result is written into the second address location ADL2 of the memory area 42-3. Thus, the address data indicating the address position of energy data E17 in the same frame can be obtained in the second address location ADL2. Next, it is checked if the address data stored in the second address location of the memory area 42-3 is larger than the memory capacity MC of the buffer memory 12. When it is detected that the former is not larger than the latter, CPU 42 produces a selection signal SL of high level and at the same time transfers the address data stored in the second address location of the memory area 42-3 to the address register 44. On the other hand, when it is detected that the address data is larger than the memory capacity MC, the memory capacity MC is subtracted from the address data and the result is written into the second address location ADL2 of the memory area 42-3, and then the same operation is effected. Thereafter, energy data E17 is read out from the buffer memory 12 in accordance with the address data stored in the address register 44. Then, the selection signal SL is set low, the energy data E17 read out from the buffer memory 12 is written into the energy table location TE(i) of the buffer memory area 42-2. The value of 1 is added to the energy data E17 stored in the energy table location TE(i) to obtain a value e which is used as an address data to designate an address location of the histogram buffer memory area 42-1. CPU 42 increments the histogram data H(e) in an address location designated by the value e.

Next, it is checked if the energy data E17 stored in the energy table TE(i) is not larger than the contents in the EMX register (not shown). If it is detected that the former is not larger than the latter, the value in the i register is incremented and the value of 17 is added to the address data in the ADR register, and the result of addition is written into the ADR register. Thus, the address position of a first energy data E1 in the next frame can be designated. On the other hand, when it is detected that the energy data E17 is larger than the contents of the EMX register, the values i and E17 now obtained are respectively stored in the M register and EMX register. Then, the same operation is effected. Thereafter, it is checked if the address data in the ADR register is larger than the address data ADR2. When it is detected that the address data is not larger than the address data ADR2, the step STPl is effected again. On the other hand, when it is detected that the address data in the ADR register becomes larger than the address data ADR2, that is, it is detected that formation of histogram for the energy data E17 between the time points A11 and A2 is completed, then it is checked in a step STP2 if the 25-scale counter 34 produces a high level output signal EPS. If it is detected that a high level output signal EPS is generated, the process of forming the histogram is terminated, and the next process for determining the threshold EP is started. On the other hand, where a high level output signal is not produced, energy data E17 is derived from the A/D converter 10 when a C17 pulse is generated in the succeeding frame. Then, the address data in the ADR register is written into the address table location ADR(i), the energy data E17 now read out is written into the energy table TE(i), and the value of 1 is added to the energy data E17 now obtained to make the new value e. Histogram data H(e) in an address location designated by the new value e is incremented by 1.

Next, it is checked if the newly detected energy data E17 is greater than the contents in the EMX register. Where the former is not greater than the latter, then the value i is incremented by 1 and the value of 17 is added to the contents of the ADR register, the result is stored in the ADR register, and then the step STP2 is effected again. On the other hand, where the newly detected energy data E17 is greater than the contents in the EMX register, the values i and E17 are respectively written into the M register and EMX register. Thereafter, the same operation is effected.

After completing the formation of histogram, the maximum energy data E17 is stored in the EMX register, the value i indicating the frame number which includes the maximum energy data E17 is stored in the M register, address data between the time points A2 and B2 are stored in the address table locations ADR(1) to ADR(N) of the memory area 42-3, energy data E17 between the time points A2 and B2 are stored in the energy table locations TE(1) to TE(N), and histogram data H(1) to H(L) are stored in the first to L-th address positions of the memory area 42-1. If X number of energy data E17 have the same value E(S), the histogram data of X will be stored in the S-th address position of the memory area 42-1. Thus, the histogram data H(e) corresponding to a graph shown in FIG. 4 can be obtained in the memory area 42-1.

Figure 6:
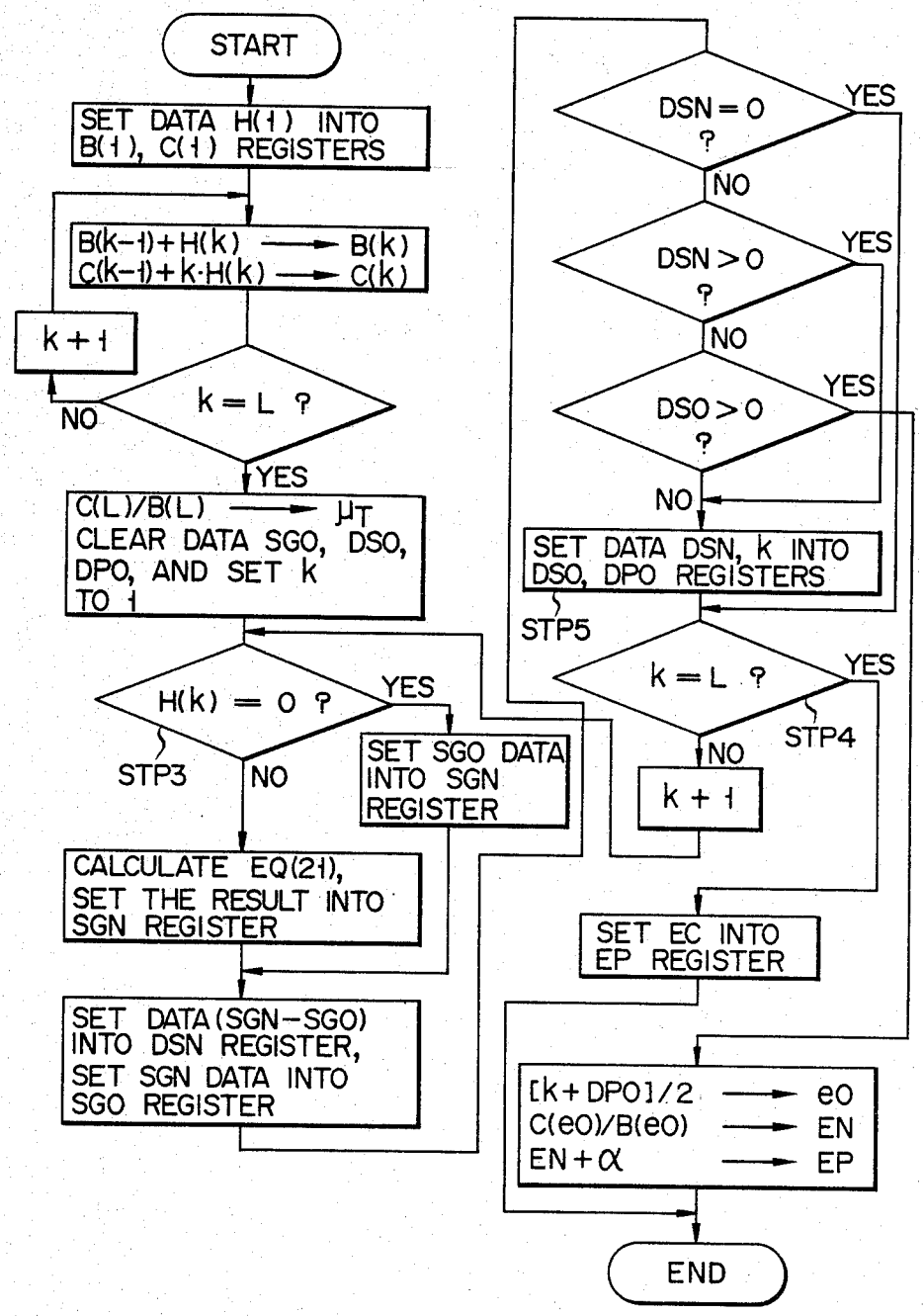
FIG. 6 is a flow chart for determining a threshold value corresponding to the average of voice parameters in a non-voice period.

Referring now to FIGS. 6, the process for determining the threshold value EP will be explained. First, the histogram data H(1) is transferred to B(1) and C(1) registers of the working memory area 42-4. Data B(2) to B(L) and C(2) to C(L) are calculated by using equations (18) and (19) and sequentially incrementing the value of k, and the data B(2) to B(L) are stored in B(2) to B(L) registers (not shown) of the working memory area 42-4 and the data C(2) to C(L) are stored in C(2) to C(L) registers (not shown) of the working memory area 42-4. In this case, the data B(L) indicates the number N of frames between the time points A2 and B2. Then, $\mu_T$ is calculated using equation (20) and stored in a $\mu_T$ register.

Next, SGO, DSO and DPO registers (not shown) in the memory area 42-4 are cleared and k is set to 1. Then, it is checked in a step STP3 if the histogram data H(k) is 0. When it is detected that the histogram data H(k) is 0, data SGO is set in an SGN register. Then, data DSN is calculated by subtracting data SGO from data SGN and stored in a DSN register, and data SGN is set in the SGO register. On the other hand, when the histogram data H(k) is not equal to 0, $\sigma_B^2(k)$ is calculated using equation (21) and set in the SGN register. Then, the same operation is effected. Thereafter, it is checked if data DSN is 0 or not. When data DSN is equal to 0 it is checked in a step STP4 if k is less than L. Where k is less than L, k is incremented by 1 and the step STP3 is effected again. When it is detected that data DSN is not equal to 0, then it is checked if data DSN is positive or not. When data DSN is positive, data DSN is set in the DSO register and the value k being used is set in the DPO register in a step STP5. Then, the step STP4 is again effected. When it is detected that data DSN is not positive, then it is checked if data DSO is positive or not. When data DSO is not positive, the step STP5 is effected again. On the other hand, when it is detected that data DSO is positive, then the value k is added to DPO data, the result of addition is divided by 2, and an integral portion of the result of division is used as $e_0$ at which $\sigma_B$ takes the maximum value as shown in FIG. 4. Then, the average EN of energy data in background noise class C1 is calculated using equation (22) and is stored in EN register. The average EN is added to a constant $\alpha$ to make a threshold value EP. On the other hand, if it is detected in the step STP4 that k is equal to L, that is, it is detected that a proper value of k at which $\sigma_B$ takes the maximum value is not determined, then a constant EC is used as a threshold value EP.

Figure 7A:
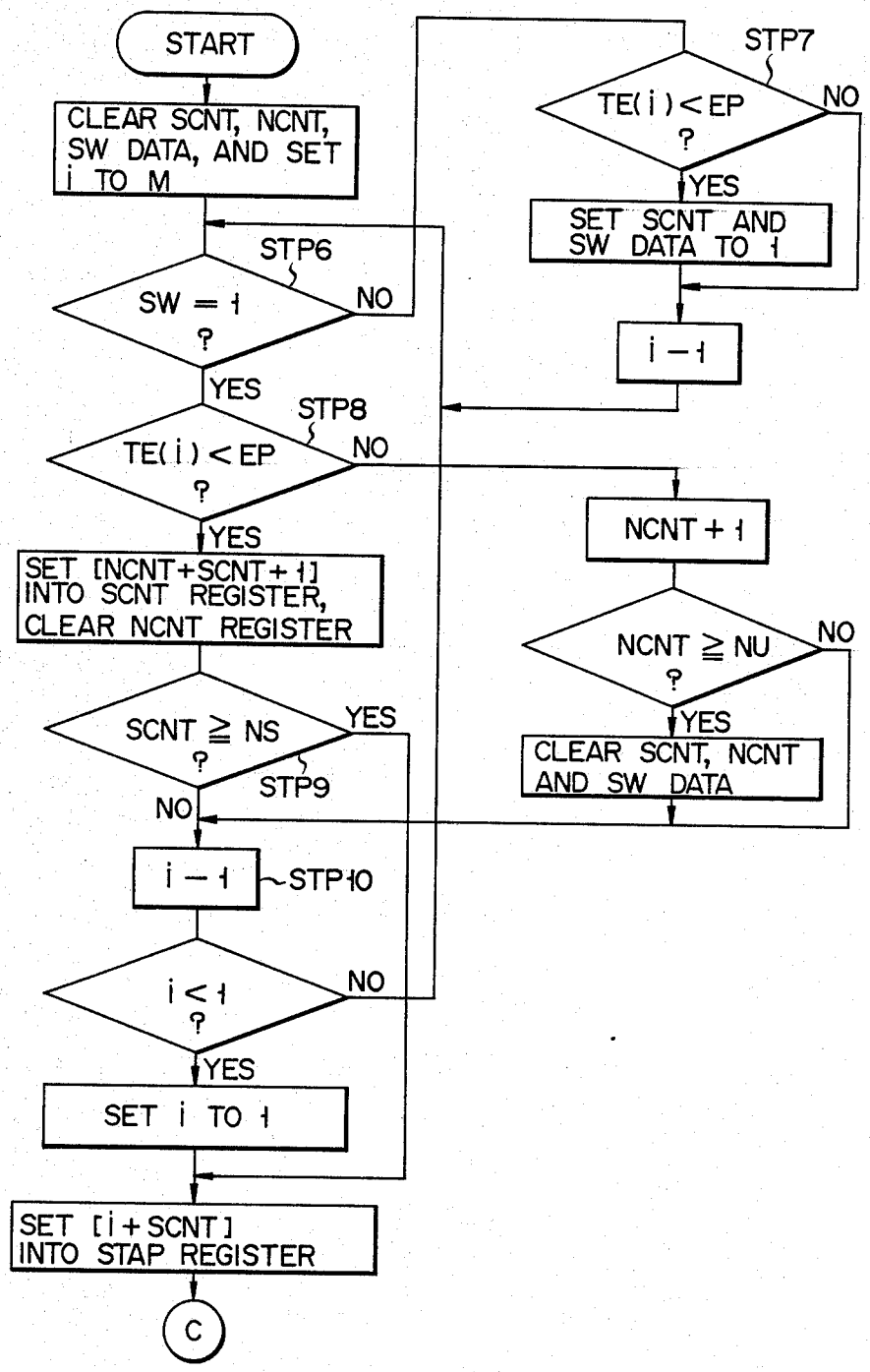
FIGS. 7A and 7B are a flow chart for determining a true voice duration based on the threshold value and voice parameters.
Figure 7B:
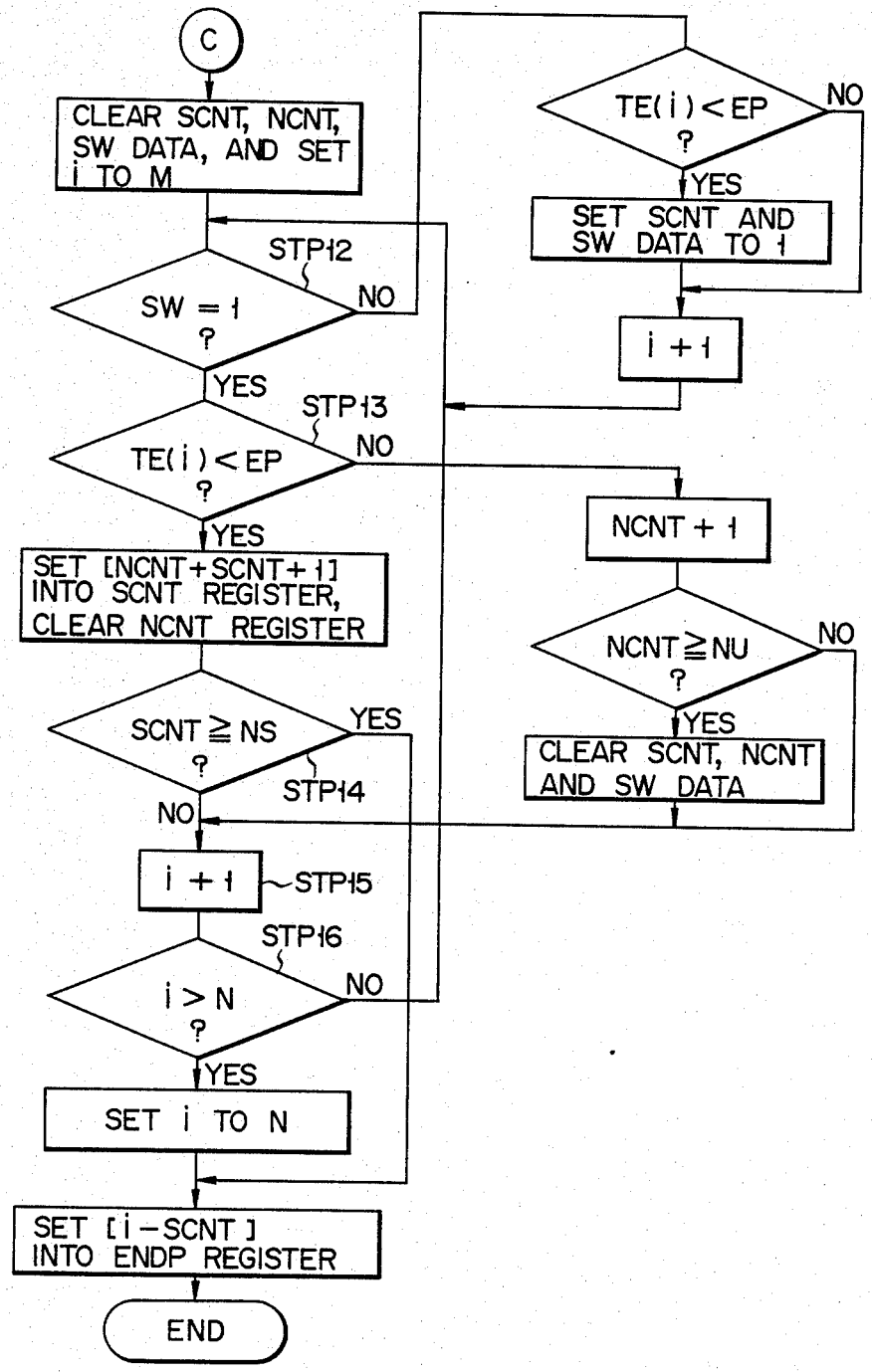

Referring now to FIG. 7, the flow chart for determining the true voice duration will be explained.

First, SCNT and NCNT count registers and SW register in the working memory area 42-4 are cleared, and address data in the M register is set in the i register. Then, if it is detected in a step STP6 that SW data is set at 0, it is checked in a step STP7 if energy data in the energy table location TE(i) is smaller than the threshold value EP. Where the former is not smaller than the latter, the value i is decremented by 1, and the step STP6 is effected again. This operation is repeatedly effected until the energy data in the energy table location TE(i) is detected in the step STP7 to be smaller than the threshold value EP, that is, until a time point A shown in FIG. 2 is reached. When it is detected in the step STP7 that the energy data in the energy table location TE(i) is smaller than the threshold value EP, the value of 1 is set in the SCNT and SW registers, and then the value i is decremented by 1. Thereafter, the step STP6 is effected again. If it is detected in the step STP6 that SW data is set at "1", it is checked in a step STP8 if energy data in the energy table location TE(i) is smaller than the threshold value EP. Where the former is smaller than the latter, the value of 1 is added to the sum of SCNT and NCNT data and the result of addition is stored in the SCNT register, and then the NCNT register is cleared. It is checked in a step STP9 if SCNT data is equal to or larger than a preset value NS which is, for example, 25. When it is detected that SCNT data is smaller than the value NS, the value i is decremented by 1 in a step STP10. Next, when the value i is detected to be equal to or larger than 1, the step STP6 is again effected, and when the value i is detected to be smaller than 1, the time point A is determined to be the true starting point and the value i is set to 1. Then, in a step STP11, the value i is added to the SCNT data and the result of addition is stored in an STAP register as data representing the time point A shown in FIG. 2. The step STP11 is also effected when the SCNT data is detected to be equal to or larger than the value NS in the step STP9.

When it is detected in the step STP8 that the energy data in the energy table location TE(i) is not smaller than the threshold value EP, the NCNT data is incremented by 1, and then it is checked if the NCNT data is equal to or larger than a preset value NU which is, for example, 4. When the former is smaller than the latter, the step STP10 is effected. On the other hand, when it is detected that the former is equal to or larger than the latter, that is, another voice section is detected, the NCNT and SCNT count registers and the SW register are all cleared to determine that the time point A should not be taken as the true starting time point, and then the step STP10 is effected.

After the step STP11 is effected, that is, the starting point A is detected, the SCNT, NCNT and SW data are all set to 0, and data in the M register is set in the i register. Then, it is checked in a step STP12 if the SW data is set at 0. Where the SW data is set at 0, it is checked if energy data in the address table location TE(i) is smaller than the threshold value EP. When it is detected that the former is not smaller than the latter, the step STP12 is effected after the value i is incremented by 1. This operation is repeatedly effected until the energy data is detected to be smaller than the threshold value EP, that is, a time point B shown in FIG. 2 is detected. Then the SCNT and SW data are set to 1, and the step STP12 is effected after the value i is incremented by 1.

When it is detected in the step STP12 that the SW data is set at 1, then it is checked in a step STP13 if energy data in the energy table location TE(i) is smaller than the threshold value EP. Where the former is smaller than the latter, the value of 1 is added to the sum of the SCNT and NCNT data and the result of addition is stored in the SCNT register. After this, the NCNT data is set to 0. Then it is checked in a step STP14 if the SCNT data becomes equal to or larger than the value NS. Where the SCNT data is smaller than the value NS, the value i is incremented by 1 in a step STP15. Thereafter, it is checked in a step STP16 if the value i is larger than N. When the value i is detected in the step STP16 to be equal to or smaller than N, the step STP12 is effected. On the other hand, when it is detected that the value i is larger than N, the time point B is determined to be the true end point and the value N is set into the i register. Then, the SCNT data is subtracted from the value i, in a step STP17, to provide ENDP data which is set in an ENDP register and represents the time point B shown in FIG. 2. The step STP17 is also effected when it is detected in the step STP14 that the SCNT data is equal to or larger than the value NS.

Further, when it is detected in the step STP13 that the energy data in the energy table location TE(i) is not smaller than the value EP, the NCNT data is incremented by 1, and then it is checked if the NCNT data is equal to or larger than the value NU. Where the NCNT data is smaller than the value NU, the step STP15 is effected again. On the other hand, when it is detected that the NCNT data is equal to or larger than the value NU, that is, another voice section is detected then the SW, NCNT and SCNT registers are all cleared to determine that the time point B should not be taken as the true end time point, and then the step STP15 is effected again.

After the true starting and end points are properly determined, CPU42 reads out energy data from the buffer memory 12 by sequentially designating addresses defined by the true starting and end points, and then tansfers the energy data to a voice recognition circuit (not shown).

Even if the ambient noise is large or even if the level of the ambient noise changes very much, the apparatus according to the invention can easily and correctly detect the duration of an input voice signal. In addition, the apparatus is simple in structure as illustrated in FIG. 1. Furthermore, the apparatus operates stably giving it great practical value. Still further, the algorithm for detecting the starting point A and the end point B of the input voice signal is therefore simple. The apparatus of the present invention can thus achieve accurate detection and is therefore highly reliable.

The present invention is not limited to the embodiment described above. For example, as voice parameters there may be used estimated errors calculated by LPC analysis, the correlation coefficient of the input voice or the like. The algorithm for calculating the distribution of voice parameters may be replaced by other algorithms. A variety of modifications are possible within the scope of the present invention.

What is claimed is:

1. An apparatus for detecting the duration of voice comprising:

sampling means for sampling an input voice signal and generating a time-sequence of voice parameters;

memory means, connected to said sampling means, for storing the time-sequence of voice parameters;

first determining means for determining an interval by examining the time-sequence of voice parameters, said interval being divided into three periods, an estimated voice period, a first non-voice period preceding said voice period and a second non-voice period succeeding said voice period;

means for forming a histogram based on the voice parameters generated during said interval and divide the voice parameters into non-voice class and voice class based on the histogram;

second determining means for determining a threshold value based on the average of voice parameters in the non-voice class; and third determining means for determining the voice duration based on the threshold value and the voice parameters generated during said interval and stored in said memory means.

2. An apparatus according to claim 1, wherein said first determining means includes a moving average circuit sequentially producing a moving average for a predetermined number of successive voice parameters from said sampling means, comparison means for comparing the moving average and a preset value, and starting and end point determining circuit for determining a temporary starting point at which said moving average becomes larger than said preset value when detecting that the moving average is kept larger than said preset value for a preset period of time after the starting point is reached and determining a temporary end point at which said moving average becomes smaller than said preset value when detecting that the moving average is kept larger than said preset value for a preset period of time after the end point is reached.

3. An apparatus according to claim 2, wherein said first determining means includes means for detecting a reference point between said temporary starting and end points, and said third determining means processes the voice parameters which are sequentially read out from said memory means starting from said reference point towards said temporary starting point to detect a true starting point, and processes the voice parameters which are sequentially read out from said memory means starting from said reference point towards said temporary end point to detect a true end point.

4. An apparatus according to claim 1, 2 or 3, wherein said means for forming a histogram includes calculation means for deriving a between-class variance from the voice parameters, and divides the voice parameters into said non-voice class and voice class with respect to a voice parameter which causes said between-class variance to take a maximum value.

5. An apparatus according to claim 1, 2 or 3, wherein said second determining means includes adding means for adding a predetermined value to said average of the voice parameters to determine said threshold value.

* * * * *